United States Patent [19]

Aker et al.

[11] 4,004,737

[45] Jan. 25, 1977

[54] CONTINUOUS HIGH VELOCITY FLUID JET SYSTEM

[75] Inventors: Walter W. Aker; Theodore T. Naydan, both of Schenectady, N.Y.

[73] Assignee: Environment/One Corporation, Schenectady, N.Y.

[22] Filed: Aug. 5, 1975

[21] Appl. No.: 602,095

[52] U.S. Cl. ..... 239/102; 138/26

[51] Int. Cl.[2] ..... B05B 17/04

[58] Field of Search ..... 239/4, 102, 101; 138/26, 31; 60/39.68

[56] References Cited

UNITED STATES PATENTS

| | | | |
|---|---|---|---|
| 2,896,862 | 7/1959 | Bede | 138/26 X |
| 3,023,574 | 3/1962 | Clement et al. | 60/39.68 X |
| 3,647,137 | 3/1972 | Naydan | 239/102 |
| 3,700,169 | 10/1972 | Naydan et al. | 239/4 |

*Primary Examiner*—Evon C. Blunk
*Assistant Examiner*—Michael Mar
*Attorney, Agent, or Firm*—Charles W. Helzer

[57] ABSTRACT

A system for producing a continuous high pressure fluid jet stream useable in underground and above ground mining and drilling for cutting a variety of different materials such as coal, mineral ore, rocks and the like. The system includes a hydroelectric pulsed liquid jet fluid pressure intensifier which employs a high energy electric arc that acts upon liquid to both heat and pressurize it to form a high energy pulsed liquid jet. The high energy pulsed liquid jet is then supplied to a pressure vessel that serves as an accumulator through a substantially zigzag tortuous path and one way check valve. The pressurized liquid is then drawn off as needed in a continuous high pressure fluid jet for performing work.

13 Claims, 4 Drawing Figures

16
16
38
36
17
17
34
15
14
12
10
10
20
22
26
24
24
28

CONTINUOUS HIGH VELOCITY FLUID JET SYSTEM

BACKGROUND

The use of high pressure fluid jet streams for cutting various materials is well known and it has been demonstrated that a high velocity stream of water can be used to work certain types of hard rock, steel and many other materials by subjecting the materials to relatively high velocity jet streams for cutting, fracturing or otherwise working the materials. Such high velocity fluid jet streams have usually been directed against the material being worked on in the form of either a pulsed or a continuous jet stream. For best control of the cutting action, continuous jet streams are preferred, although pulsed jets of high velocity fluid have been found useful in some instances where a continuous cutting stroke is not essential or not capable of achieving the cutting or fracturing effect desired.

High velocity fluid jet streams have been produced in the past with mechanical intensifiers. The known mechanical intensifiers generally employ hydraulic power driven pistons of large diameter directly connected to drive smaller pistons that deliver the high pressure fluid. Such known apparatus are plagued with all the attendant problems of sealing, cylinder and piston wear, and need for complex valving arrangements.

BRIEF DESCRIPTION OF THE INVENTION

The apparatus of this invention produces a continuous high velocity fluid jet stream for cutting, fracturing, or otherwise impacting or working on materials of the above-listed nature. The fluid jet stream preferably is in the form of a high velocity jet stream of water. The apparatus employs a novel electrical, pulse actuated fluid pressure intensifier for use as a pumping means to feed a fluid pressure accumulator with the pressurized fluid in the accumulator being used to produce the continuous high velocity fluid jet stream.

The fluid pressure intensifier comprises an apparatus for the production of hydroelectric pulsed liquid jets of the type disclosed and claimed in U.S. Pat. Nos. 3,700,169 and 3,647,137. The fluid pressure intensifier produces a high energy electric arc that acts upon the fluid to impart energy to the fluid in the form of a high temperature expanding gaseous bubble containing superheated steam as well as ionized and neutral molecules of the fluid, a high pressure sonic front and a high intensity light energy pulse, all of which are converted into heat and pressurization of the fluid. Such energy input to a fluid is accomplished with a high energy electrical discharge through the fluid as disclosed in U.S. Pat. No. 3,700,169 issued Oct. 24, 1972 and in U.S. Pat. No. 3,647,137 issued Mar. 7, 1972 in the names of Theodore T. Naydan and Walter W. Aker, Inventors, and assigned to the Environment/One Corporation.

The fluid pressure intensifier for increasing the energy of the fluid makes use of an intermittent, high energy, electrical arc that is discharged across electrode means positioned in a body of the fluid to be pressurized. The intermittent, high energy electric arc is produced by "stepping-up" or "intensifying" electric energy supplied from commercial power supply lines at normally available voltage and current through the use of step-up transformers, rectifiers and a capacitor storage bank in a manner well known in the electrical industry. The stepped-up or intensified stored electrical energy then efficiently is converted in the fluid mass from electrical energy into mechanical energy to heat and pressurize the fluid. The pressurized fluid then is transferred into a suitable accumulator where the changes in fluid pressure are smoothed out, and from which a continuous jet stream of high velocity fluid may be drawn and directed against material to be cut with high impact energy.

DETAILED DESCRIPTION OF PREFERRED EMBODIMENTS

Figure 1:
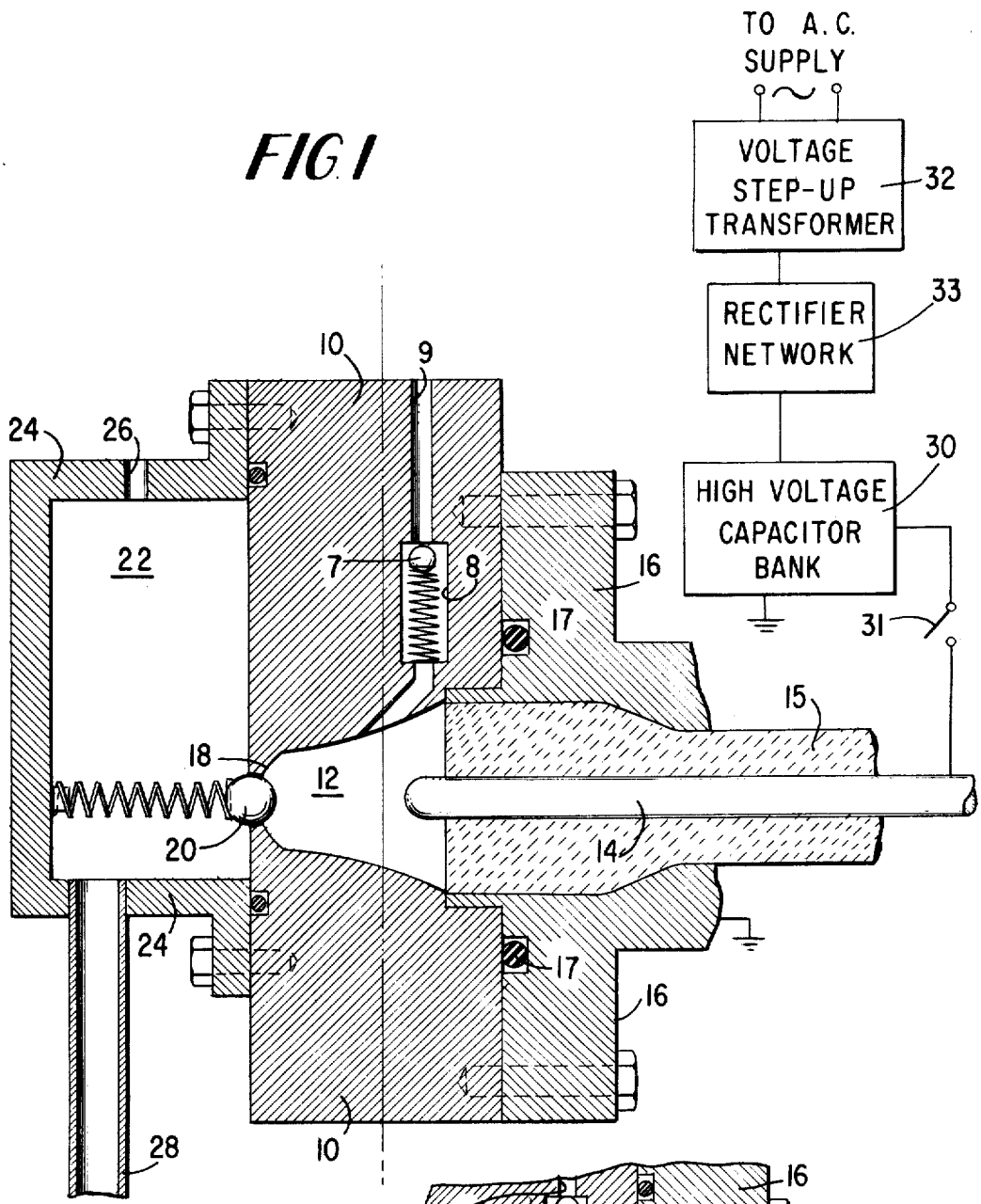
FIG. 1 is a schematic sectional view of a new and improved continuous high velocity water jet system employing an electrical arc fluid pulse intensifier and high pressure fluid accumulator.

FIG. 1 of the drawings is a partially broken-away schematic illustration of a new and improved, continuous high velocity fluid jet system according to the invention. The system can be used to produce a high velocity fluid jet stream for cutting or otherwise working on materials such as coal, wood, cloth, cardboard, coated abrasives, glass fiber products, plastics, roofing materials, leather, cork, food and the like. The system employs a fluid pressure intensifier which is comprised by a known device of the type described in the above-referenced U.S. Pat. Nos. 3,700,169 and 3,796,463. For a more complete description of the structure and mode of operation of this known device, reference is made to these prior art patents, the disclosures of which are hereby incorporated in their entirety. The present invention utilizes these known devices for adding energy to a fluid in a system for providing a continuous high pressure, high velocity, fluid jet stream useful for cutting or otherwise working materials like those listed above.

As shown in FIG. 1, the new and improved system includes a fluid pressure intensifier body 10 of heavy gauge, high strength steel and provided with a cavity or arc discharge chamber 12 for receiving fluid to be acted upon. The fluid, preferably water, may be fed into chamber 12 through a suitable feed means such as a passageway 9, including a large portion 8 in which a spring-loaded ball check valve 7 is seated. The passageway 9 is connected to a suitable source of fluid which preferably is water but may comprise any relatively incompressible fluid.

The arc discharge chamber 12 is closed at one of the ends thereof by an electric arc discharge electrode 14 supported within a high grade electrically insulating sleeve 15 held in place on the body member 10 by a relatively thick, high strength steel collar 16. An O-ring gasket 17 serves to seal the interior of the chamber 12 and prevent leakage of increased pressure fluid out past the junction of body member 10 with collar 16. As described more fully in the above-referenced patents, the electrode 14 is adapted for connection to a high energy storage capacitor bank through a suitable high voltage switching arrangement for producing periodic discharges of a high energy electric arc in cavity 12 between electrode 14 and the side walls of body member 10 defining cavity 12.

Figure 1A:
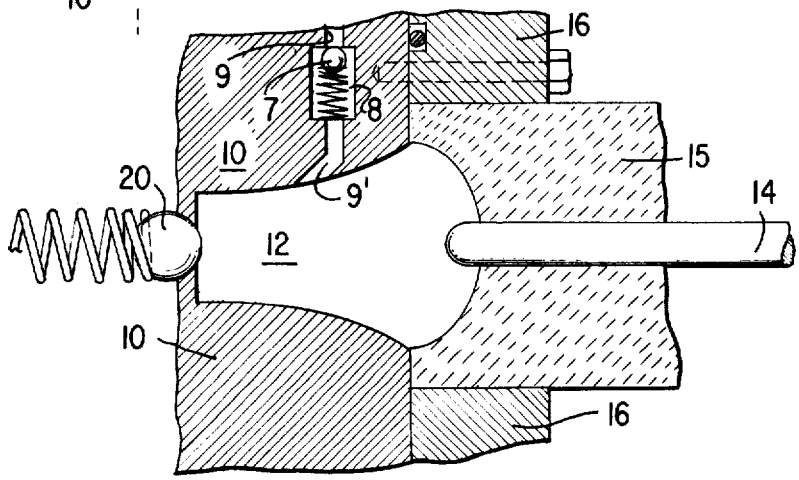
FIG. 1A is a partial sectional view of a modified construction for the arc discharge electrode and cavity used in the embodiment of the invention shown in FIG. 1.

It should be remembered in viewing FIG. 1 that the Figure is intended as a schematic illustration of the principal features of the invention. In actual construction, it may be desired to shape the side walls of cavity 12 so as to conform their configuration to a cissoid of Diocles; and to shape the end of the insulator body 15 confronting cavity 12 to form a parabolic reflector as illustrated in FIG. 1A and disclosed further in the above-referenced patent, U.S. Pat. No. 3,647,137. Preferably, the inlet fluid passageway 9 is diverted away from the electrode 14 at a point of entry into cavity 12 as shown at 9 in FIG. 1A, to minimize possible erosion of the electrode by inflowing fluid. Further, the parabolic-shaped insulator surface of FIG. 1A serves to focus the energy of the arc discharge on the cissoid nozzle outlet closed by spring-loaded ball valve 20, as explained in U.S. Pat. No. 3,647,137. In addition, the parabolic-shaped end surface of the insulator assures that the shortest discharge path for an electric arc is directly through the fluid medium in cavity 12 between electrode 14 and the side walls of cavity 12 and not along the surface of the insulator. This will tend to minimize erosion of the insulator surface by the repeated electric arc discharges.

Fluid introduced into cavity 12 through passageway 9 and ball check valve 7, normally is constrained to remain in cavity 12 by a second, large ball check valve 20 that closes an outlet 18 formed in body 10 at end of cavity 12. Outlet 18 communicates with the interior of a pressurized fluid accumulator chamber 22 defined by relatively thick high strength, steel side walls 24. Accumulator 22 has a vent valve 26 formed in one of the side walls 24 and has a discharge outlet opening connected to a high pressure outlet passageway 28 for delivery of a continuous flow high velocity fluid jet to a workpiece, etc. If desired, a high pressure on-off control valve (not shown) can be included in the discharge outlet passageway 28 for controlling delivery of the continuous flow high velocity fluid jet.

As described more fully in U.S. Pat. No. 3,700,169, the periodic high energy electric discharge arcs are produced across the electrode 14 and walls of arc discharge chamber 12, by selective and repeated connection of the electrode 14 to a charged capacitor bank 30 through a suitable switching arrangement 31 with the body member 10 electrically grounded. High electrical charges are stored in the capacitor bank 30 from conventional industrial and commercial alternating current electric power sources through a suitable voltage step-up transformer 32 and rectifier network 33 arrangement in a manner well known in the electric power industry. With this arrangement, it will be appreciated that the present system employs ready and easily accomplished stepping-up or intensification of the electric energy level with the step-up transformer, rectifier and capacitor bank network arrangement in contrast to the known prior art mechanical arrangements which employ mechanical intensification with all the attendant problems associated with large mechanical power amplifiers.

Upon initially placing the continuous high velocity fluid jet system in operation, cavity 12 and accumulator 22 are first filled with fluid such as water, for example, while air in the system is bled off through the vent 26 and associated valve (not shown). Thereafter, the capacitor bank 30 is charged to a desired energy level. The output from the capacitor bank is then switched into circuit relationship with electrode 14 to produce a high energy electric discharge arc between electrode 14 and the side walls of discharge chamber 12. The production of the high energy electric discharge arc directly within the fluid or water mass in chamber 12 releases a burst of energy within this mass. This energy is immediately made evident in the form of mechanical energy to move some of the water through outlet passage 18 past the one way ball check valve 20 and into the accumulator chamber 22. In addition to mechanical energy for moving the fluid, extremely high temperatures are available for vaporizing the fluid and converting some of the water into superheated steam and both ionized and neutral molecules. Also, some of the energy of the arc is exhibited in the form of light which is absorbed in the fluid to further heat the mass as it flows through the outlet 18 into accumulator 22.

Repeated operation of the arc results in driving or pumping small amounts of the highly energized fluid into accumulator 22. The accumulator holds the fluid under pressure and after sufficient pumping action by the intensifier arc discharge chamber has taken place to pressurize the accumulator, fluid under the pressure prevailing in accumulator 22 may be fed through discharge outlet passageway 28 and an outlet nozzle (not shown) to provide the high velocity continuous fluid jet stream for cutting, fracturing or otherwise working material.

Figure 3:
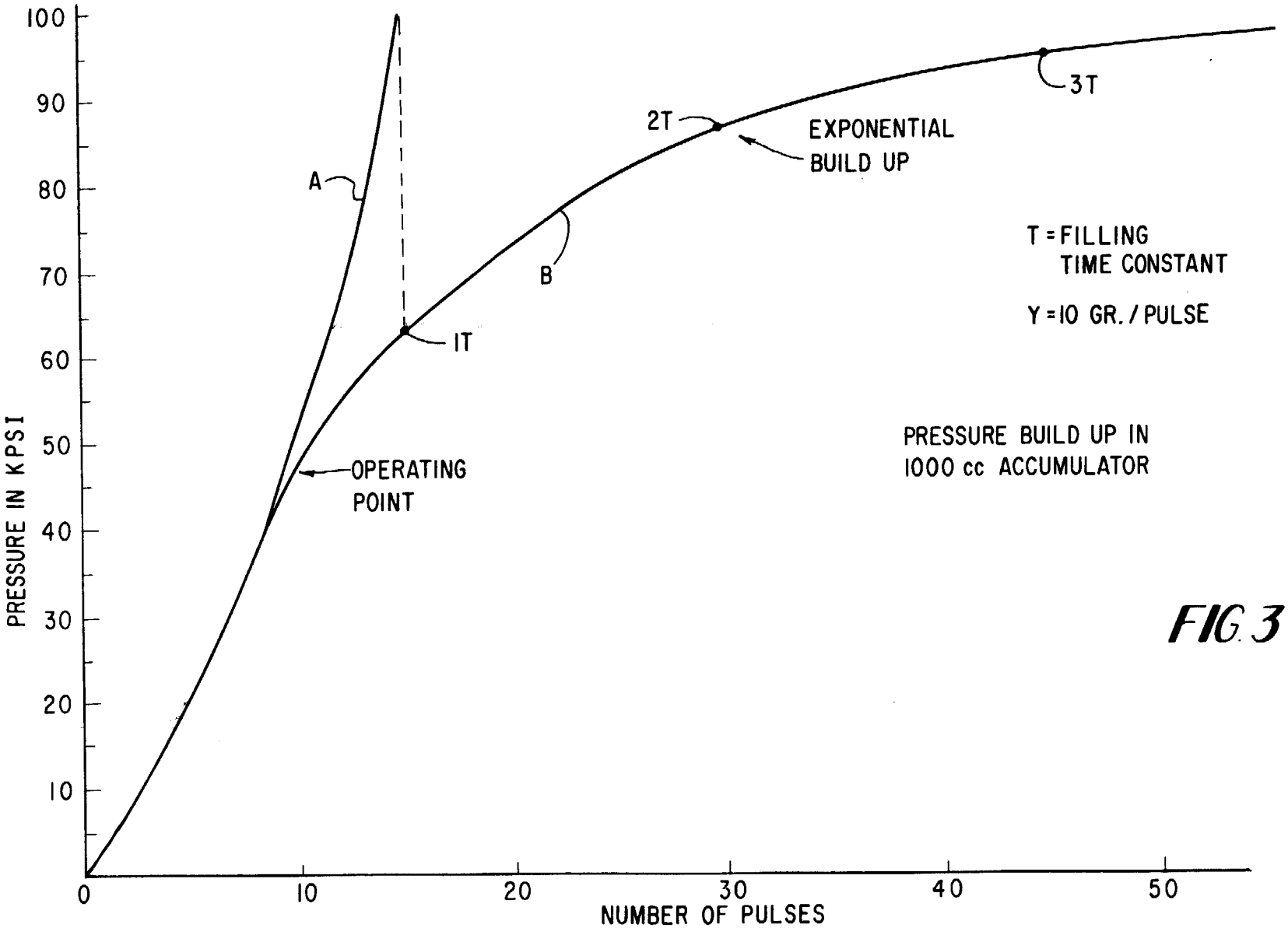
FIG. 3 is a plot of data showing the relationship of fluid pressure buildup in the accumulator vs. the number of electric arc discharge pulses produced in the fluid pressure intensifier.

After the electric arc intensifier has been started, the pressure within the accumulator 22 quickly builds up to the desired working pressure range so that cutting or other work can proceed. FIG. 3 shows the relationship of the build-up in pressure within accumulator chamber 22 for increasing numbers of electric arc discharge pulses. FIG. 3 shows a fairly linear theoretical pressure along line (A) for a 1000 cc. accumulator when a constant value of 10 grams of water per pulse is driven into the accumulator at a peak pulse pressure of 100,000 pounds per square inch (100 Kpsi). This line represents a linear pressurization charging rate of 3000 psi per second at the initial starting time of $t_o$. In actual practice, the real pressure build-up is exponential along portion (B) rather than linear as accumulator back pressing begins to approach cavity driving pressure. It has been deduced by electrical analogy that when the nearly linear portion (A) intercepts the 100 Kpsi value line, the corresponding number of pulses at that point will represent one filling time constant (1T) of the accumulator. This turns out to be 63 percent of the peak input pressure value of 100 Kpsi. From FIG. 3 it can be seen that 15 input pulses delivered within one time constant (1T) will produce a pressure build-up of P = 63 Kpsi in the accumulator.

The exponential charge curve (B) also represents the pressurization discharge rate for each pulsed operation of the electric discharge arc which in this example is 3000 psi per second. The system stabilizes at 50 Kpsi or near it when the discharge rate is equal to the input rate as indicated by the point on the curves where the discharge slope = the charge slope. This is shown in FIG. 3 as occurring at a peak pressure value of 50 Kpsi for the accumulator 22 plus a 3 Kpsi ripple (6%). One can obtain 50 Kpsi steady state operating condition by using a 1000 cc. accumulator with the electric discharge arc operating at 1–2 pulses per second and with 10 grams per pulse being injected into the accumulator. The discharge rate at the output nozzle of the continuous high velocity jet stream withdrawn from the accumulator will then be 10 grams per second or 9.5 gallons per hour. Thus, it will be appreciated that the accumulator serves to integrate or smooth-out the pulsed nature of the increases in pressure applied to the accumulator from the electric arc discharge pressure intensifier, and to deliver at its output a continuous, high velocity fluid jet.

Figure 2:
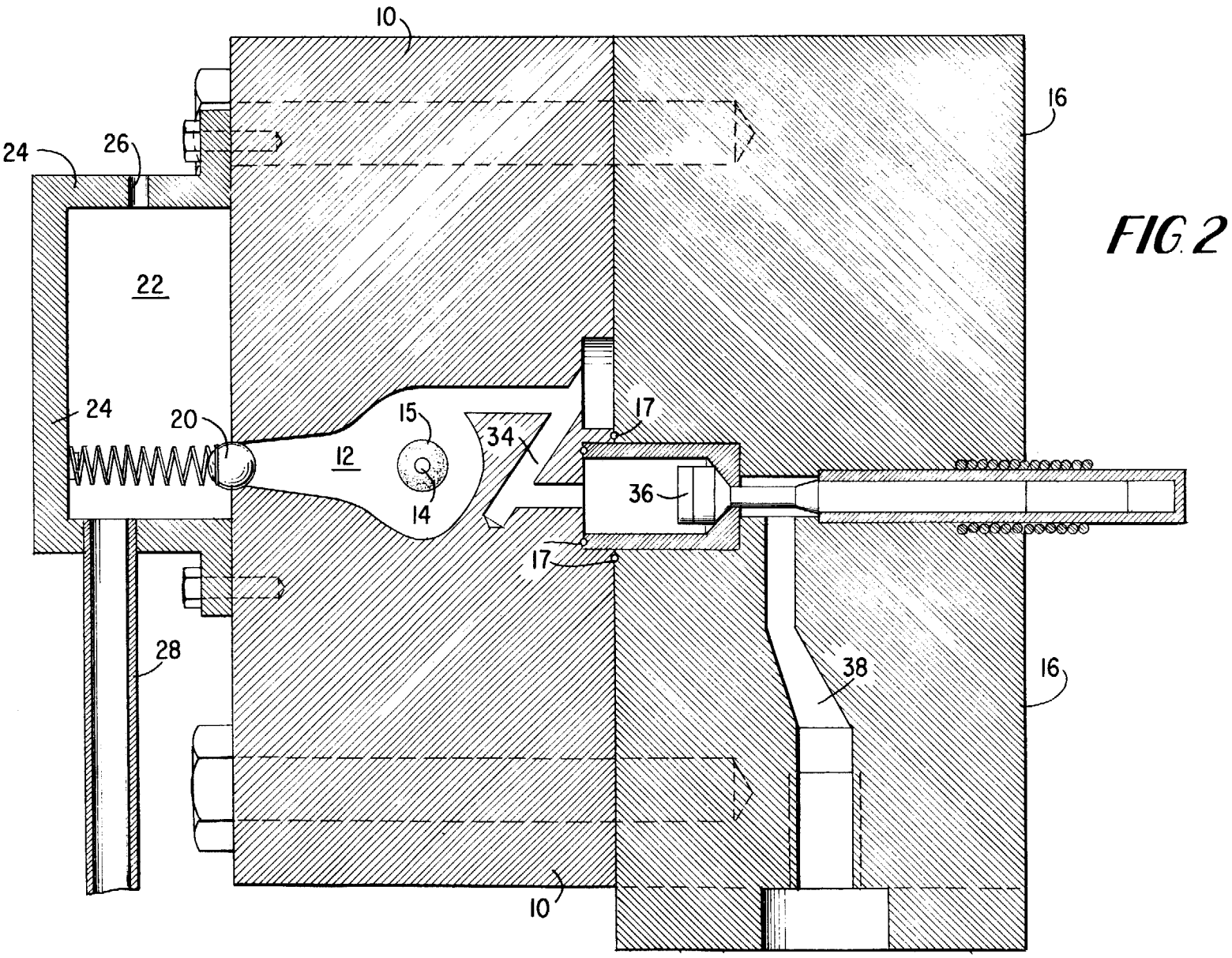
FIG. 2 is a sectional schematic view through an alternate form of fluid pressure intensifier particularly adapted for pressurizing water for use in a continuous high velocity fluid jet stream cutting apparatus according to the invention.

FIG. 2 is a schematic illustration of a modified system according to the invention which provides for a continuous supply of inlet water to the electric discharge arc intensifier. In FIG. 2 the electric arc discharge chamber 12 is pear-shaped with the outlet end ball check valve 20 at the small neck of the chamber, leading to the accumulator. Parts in FIG. 2 corresponding to those described with reference to FIG. 1 have been identified with the same reference character. The discharge electrodes in FIG. 2 are comprised of two opposing electrodes 14 and surrounding insulators 15, one extending into the plane of the paper and one extending out of the plane of the paper. Electric arc discharge takes place between opposed ends of the electrodes 14 across chamber 12. Fluid infeed to chamber 12 takes the form of a Z-shaped passage 34 that is connected between an infeed control valve 36 and arc discharge chamber 12. When the valve 36 is open, inlet water can flow into passage 34 from the conduit 38 connected to a suitable source of supply. The water flows easily through the Z-shaped passage under relatively low pressure, to fill chamber 12 in less than ½ second of time, then valve 36 closes to the position shown in FIG. 2. The valve 36 may be a solenoid actuated valve that is operated synchronously with the electric arc discharge.

After the chamber 12 and associated accumulator 22 have been filled, the electric arc is discharged through chamber 12. A rapid buildup of well above 100,000 pounds per square inch pressure takes place to drive a slug of water from chamber 12 into the accumulator 22 through ball check valve 20. This same buildup in pressure is exerted backwardly against the water through passage 34; however, due to the Z-shape and relative incompressibility of water and valve 36, a very great backward resistance is introduced which eliminates any tendency toward a back flow through the inlet water supply passages 38 which at this point is closed as shown in FIG. 2.

The data given above applies primarily to a pulsed electric arc discharge system for pumping water into an accumulator for the purposes of this invention. However, other fluid sources or mixtures of water and another fluid or mixtures of other fluids can be successfully employed. Accordingly, while a preferred exemplification of the invention has been described, other modifications and variations will be obvious to those skilled in the art in the light of the above teachings. It is, therefore, to be understood that any such obvious modifications or variations are deemed to fall within the scope of the present invention as defined by the appended claims.

What is claimed is:

1. An apparatus for producing a continuous high velocity fluid jet stream comprising a high pressure accumulator to receive pulses of fluid under pressure, fluid pressure intensifying means for delivering fluid under pressure into said accumulator, said fluid pressure intensifying means comprising a high pressure chamber for receiving fluid, electrical arc discharge means disposed in said chamber, fluid inlet means to supply fluid from a fluid source into said chamber, said fluid inlet means comprising a zig zag passageway having a multiplicity of turns for increasing frictional resistance to the flow of high pressure fluid, fluid inlet check valve means interconnected between the fluid source and the zig zag passageway for preventing the back flow of pressurized fluid into the fluid source, a high pressure fluid outlet passageway leading from said chamber into said accumulator, fluid outlet check valve means in said outlet passageway to permit fluid under pressure to flow from said chamber into said accumulator and to prevent backflow of fluid under pressure from said accumulator back into said chamber, electric supply means for supplying high voltage electric energy to said electric arc discharge means to produce a high energy electric discharge arc through the fluid in said chamber to raise its pressure and deliver a pulse of fluid under pressure from the chamber into said accumulator, and outlet means from said accumulator for delivery of a continuous high velocity fluid jet stream.

2. An apparatus according to claim 1 wherein said electric supply means comprises a high voltage capacitor storage bank charged from a conventional source of alternating current electric energy through a voltage step-up transformer and rectifier network whereby large energy intensification is accomplished electrically in advance of converting the large electric energy to large kinetic energy of the water plug by means of the electric arc discharge.

3. An apparatus according to claim 1 wherein said electric arc discharge means includes a spaced apart electrode means formed in said chamber whereby a high energy electric arc is produced in the chamber upon a source of high voltage being connected to said electrode means by said electric supply means.

4. An apparatus as in claim 1 wherein the fluid fed into the chamber is water.

5. An apparatus according to claim 1 wherein the electric arc discharge fluid pressure intensifying means is operative to move fluid into the accumulator at a pressure of the order of 100,000 pounds per square inch, said system delivers a continuous high velocity fluid jet stream at a pressure of the order of 50,000 pounds per square inch, the volume of fluid infeed to the accumulator substantially equals the volume of fluid delivered from the accumulator, and the pressure in the accumulator stabilizes at a pressure of the order of 50,000 pounds per square inch.

6. An apparatus according to claim 1 wherein said electric arc discharge chamber is shaped to accentuate the forces acting on the fluid as it is energized and moved from said chamber into said accumulator.

7. An apparatus according to claim 3 wherein the spaced apart electrode means is comprised by an insulatingly supported, centrally disposed electrode member and the side walls of chamber, and the electric supply means is connected across the centrally disposed electrode member and the side walls of the chamber.

8. An apparatus according to claim 7 wherein the high pressure fluid outlet passageway is disposed in a common wall with the accumulator, and the centrally disposed electrode member is spaced directly across the chamber on an opposite end wall from the outlet passageway to drive the fluid directly toward and through the outlet passageway.

9. An apparatus according to claim 1 wherein the fluid outlet check value means to prevent backflow of fluid under pressure from the accumulator back into said chamber comprises spring-loaded ball check valve means.

10. An apparatus according to claim 1 wherein said fluid inlet check valve means comprises selectively operable inlet check valve means controlled synchronously with the electrical arc discharge means.

11. An apparatus according to claim 1 wherein said pump chamber is pear-shaped to accentuate the forces acting on the fluid from the electric arc discharge, the high pressure fluid outlet passageway communicates with the accumulator at the small neck end of the chamber, a fluid inlet communicates with the enlarged cavity portion of the chamber and is shaped in the form of an essentially Z-shaped path between the chamber and a source of fluid to be fed into the chamber.

12. An apparatus according to claim 11 wherein said fluid inlet check valve means comprises selectively operable inlet check valve means controlled synchronously with the electrical arc discharge means connected in the inlet passageway intermediate the fluid inlet supply and the Z-shaped path to permit fluid flow into the chamber and prevent backflow from the chamber towards the inlet supply.

13. An apparatus according to claim 12 wherein said electric arc discharge means comprises a pair of spaced apart electrode members insulating supported on opposite sidewalls of the chamber to produce an electric arc across said chamber.

* * * * *